US010522902B1

(12) United States Patent
Tseng et al.

(10) Patent No.: US 10,522,902 B1
(45) Date of Patent: Dec. 31, 2019

(54) ANTENNA STRUCTURE

(71) Applicant: Quanta Computer Inc., Taoyuan (TW)

(72) Inventors: Yi-Ling Tseng, Taoyuan (TW); Chung-Hung Lo, Taoyuan (TW); Chin-Lung Tsai, Taoyuan (TW); Ching-Hai Chiang, Taoyuan (TW); Kuan-Hsien Lee, Taoyuan (TW); Ying-Cong Deng, Taoyuan (TW); Chung-Ting Hung, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 0 days.

(21) Appl. No.: 16/137,580

(22) Filed: Sep. 21, 2018

(30) Foreign Application Priority Data

Jul. 26, 2018 (TW) ..... 107125869 A

(51) Int. Cl.

| | |
|---|---|
| ***H01Q 1/24*** | (2006.01) |
| ***H01Q 1/48*** | (2006.01) |
| ***H01Q 5/30*** | (2015.01) |
| ***H01Q 9/04*** | (2006.01) |

(52) U.S. Cl.
CPC ..... *H01Q 1/243* (2013.01); *H01Q 1/48* (2013.01); *H01Q 5/30* (2015.01); *H01Q 9/0442* (2013.01)

(58) Field of Classification Search
CPC .. H01Q 1/243; H01Q 1/48; H01Q 5/30–5/35; H01Q 9/0407–9/0442
USPC ..... 343/702, 846
See application file for complete search history.

(56) References Cited

U.S. PATENT DOCUMENTS

| | | | | |
|---|---|---|---|---|
| 8,907,853 | B2 * | 12/2014 | Ying | H01Q 1/243 343/702 |
| 2015/0022422 | A1 * | 1/2015 | Chang | H01Q 1/243 343/861 |
| 2018/0053990 | A1 * | 2/2018 | Caballero | H01Q 1/243 |
| 2018/0183137 | A1 * | 6/2018 | Tsai | H01Q 9/42 |

* cited by examiner

*Primary Examiner* — Dameon E Levi
*Assistant Examiner* — Hasan Z Islam
(74) *Attorney, Agent, or Firm* — McClure, Qualey & Rodack, LLP

(57) ABSTRACT

An antenna structure includes a ground plane, a first feeding element, a second feeding element, a connection element, a first radiation element, a second radiation element, a third radiation element, a first tuning circuit, a second tuning circuit, a third tuning circuit, and a fourth tuning circuit. The ground plane has a notch region. The first tuning circuit is coupled between a signal source and the first feeding element. The second tuning circuit is coupled between the first feeding element and the second feeding element. The third tuning circuit is coupled between the second feeding element and the ground plane. The first radiation element is coupled to the first feeding element. The fourth tuning circuit is coupled between the first radiation element and the ground plane. Both the second radiation element and the third radiation element are coupled through the connection element to the second feeding element.

10 Claims, 3 Drawing Sheets

ANTENNA STRUCTURE

CROSS REFERENCE TO RELATED APPLICATIONS

This Application claims priority of Taiwan Patent Application No. 107125869 filed on Jul. 26, 2018, the entirety of which is incorporated by reference herein.

BACKGROUND OF THE INVENTION

Field of the Invention

The disclosure generally relates to an antenna structure, and specifically, to a wideband antenna structure.

Description of the Related Art

With the progress being made in mobile communication technology, mobile devices such as portable computers, mobile phones, tablet computers, multimedia players, and other hybrid functional mobile devices have become common. To satisfy the demands from users, mobile devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

An antenna is an indispensable element in a mobile device for supporting wireless communication. However, the inner space of the mobile device is limited, and there is insufficient area for accommodating the necessary antenna element. Accordingly, it has become a critical challenge for engineers to design a small-size wideband antenna element.

BRIEF SUMMARY OF THE INVENTION

In a preferred embodiment, the disclosure is directed to an antenna structure including a ground plane, a first feeding element, a second feeding element, a connection element, a first radiation element, a second radiation element, a third radiation element, a first tuning circuit, a second tuning circuit, a third tuning circuit, and a fourth tuning circuit. The ground plane has a notch region. The first tuning circuit is coupled between a signal source and the first feeding element. The second tuning circuit is coupled between the first feeding element and the second feeding element. The third tuning circuit is coupled between the second feeding element and a first shorting point on the ground plane. The first radiation element is coupled to the first feeding element. The fourth tuning circuit is coupled between the first radiation element and a second shorting point on the ground plane. The connection element is coupled to the second feeding element. The second radiation element is coupled to the connection element. The third radiation element is coupled to the connection element. A 3D (Three-Dimensional) structure is formed by the connection element, the second radiation element, and the third radiation element.

In some embodiments, a planar structure is formed by the first feeding element, the second feeding element, and the first radiation element, and the planar structure is disposed inside the notch region.

In some embodiments, any of the first tuning circuit, the second tuning circuit, the third tuning circuit, and the fourth tuning circuit is a capacitor, an inductor, or a resistor.

In some embodiments, the connection element is substantially perpendicular to the ground plane.

In some embodiments, the second radiation element and the third radiation element are positioned on a plane which is different from and substantially parallel to the ground plane.

In some embodiments, a combination of the second radiation element and the third radiation element substantially has a U-shape.

In some embodiments, the antenna structure covers a first frequency band at or around 1575 MHz, a second frequency band from 2400 MHz to 2500 MHz, and a third frequency band from 5150 MHz to 5850 MHz.

In some embodiments, the total length of the first feeding element and the first radiation element is shorter than 0.25 wavelength of the first frequency band.

In some embodiments, a total length of the first feeding element, the second feeding element, the connection element, and the second radiation element is substantially equal to 0.25 wavelength of the second frequency band.

In some embodiments, the total length of the first feeding element, the second feeding element, the connection element, and the third radiation element is substantially equal to 0.25 wavelength of the third frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are described in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
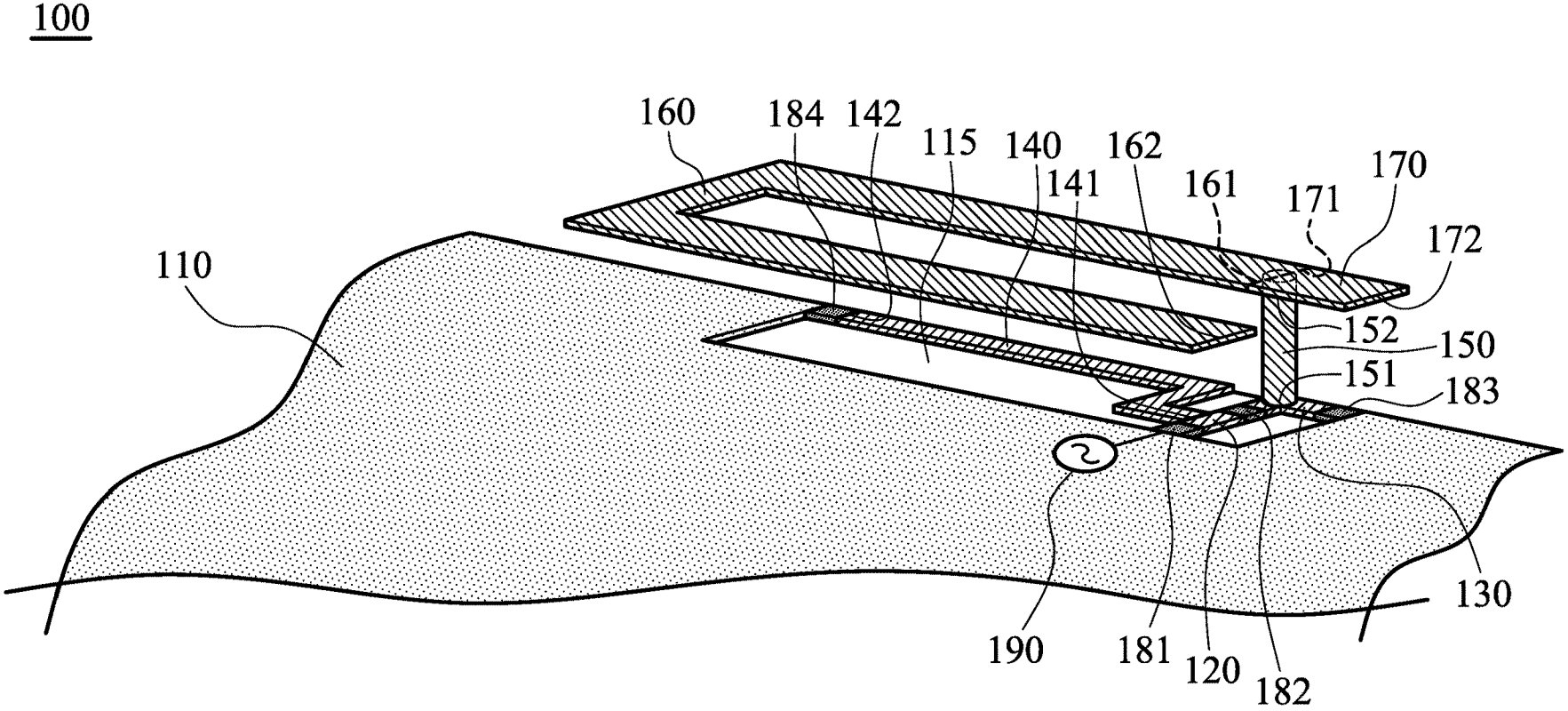
FIG. 1A is a perspective view of an antenna structure according to an embodiment of the invention.
Figure 1B:
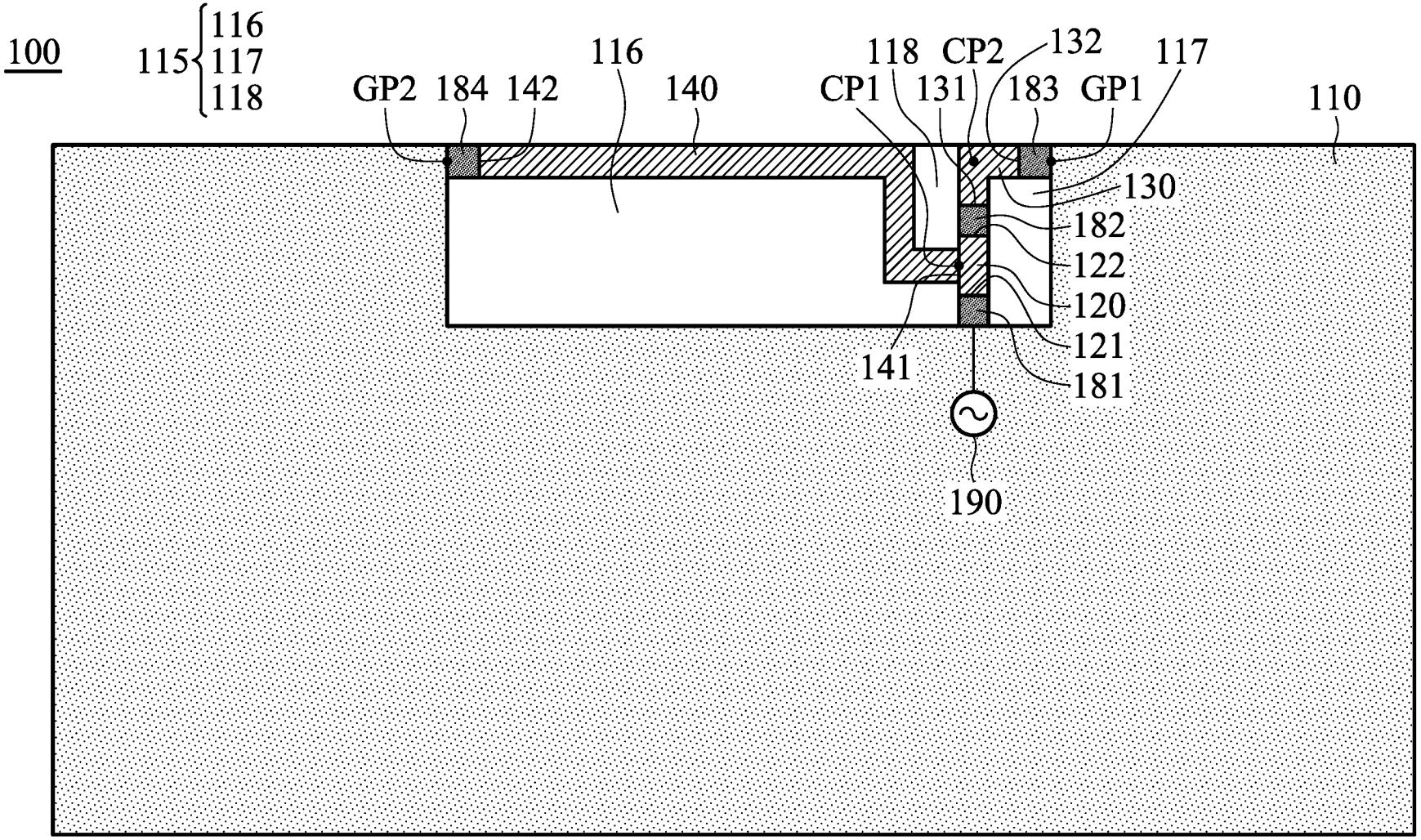
FIG. 1B is a top view of an antenna structure according to an embodiment of the invention.

FIG. 1A is a perspective view of an antenna structure 100 according to an embodiment of the invention. As shown in FIG. 1A, the antenna structure 100 includes a ground plane 110, a first feeding element 120, a second feeding element 130, a first radiation element 140, a connection element 150, a second radiation element 160, a third radiation element 170, a first tuning circuit 181, a second tuning circuit 182, a third tuning circuit 183, and a fourth tuning circuit 184. FIG. 1B is a top view of the antenna structure 100 according to an embodiment of the invention. To simplify the figure, the connection element 150, the second radiation element 160, and the third radiation element 170 are omitted in FIG. 1B. Please refer to FIG. 1A and FIG. 1B together to understand the invention.

The ground plane 110, the first feeding element 120, the second feeding element 130, the first radiation element 140, the connection element 150, the second radiation element 160, and the third radiation element 170 may be made of metal materials, such as copper, silver, aluminum, iron, or their alloys. Each of any one or more of the first tuning circuit 181, the second tuning circuit 182, the third tuning circuit 183, and the fourth tuning circuit 184 may be a capacitor, an inductor, or a resistor. A signal source 190 may be an RF (Radio Frequency) module for exciting the antenna structure 100.

The ground plane 110 has a notch region 115. The notch region 115 may be positioned at an edge of the ground plane 110. The shapes and sizes of the ground plane 110 and the notch region 115 are not limited in the invention. For example, the ground plane 110 may substantially have a large rectangular shape, and the notch region 115 may substantially have a small rectangular shape. In some embodiments, the ground plane 110 is disposed on a dielectric substrate, such as a PCB (Printed Circuit Board), an FR4 (Flame Retardant 4) substrate, or an FPC (Flexible Circuit Board). The notch region 115 is a non-metal region on the dielectric substrate, and the non-metal region is considered as a clearance region of the antenna structure 100.

A planar structure may be formed by the first feeding element 120, the second feeding element 130, and the first radiation element 140. The whole planar structure may be disposed inside the notch region 115 of the ground plane 110. In addition, the first tuning circuit 181, the second tuning circuit 182, the third tuning circuit 183, and the fourth tuning circuit 184 may be all completely inside the notch region 115 of the ground plane 110.

The first feeding element 120 may substantially have a straight-line shape. The first feeding element 120 has a first end 121 and a second end 122. The first tuning circuit 181 is coupled between the signal source 190 and the first end 121 of the first feeding element 120. The second feeding element 130 may substantially have an L-shape. The second feeding element 130 has a first end 131 and a second end 132. The second tuning circuit 182 is coupled between the second end 122 of the first feeding element 120 and the first end 131 of the second feeding element 130. The third tuning circuit 183 is coupled between the second end 132 of the second feeding element 130 and a first shorting point GP1 on the ground plane 110.

The first radiation element 140 may substantially have an N-shape or a Z-shape. The length of the first radiation element 140 is longer than the total length of the first feeding element 120 and the second feeding element 130. The first radiation element 140 has a first end 141 and a second end 142. The first end 141 of the first radiation element 140 is coupled to a first connection point CP1 on the first feeding element 120. The fourth tuning circuit 184 is coupled between the second end 142 of the first radiation element 140 and a second shorting point GP2 on the ground plane 110. The second shorting point GP2 is different from the first shorting point GP1. The first shorting point GP1 and the second shorting point GP2 may be substantially positioned at two opposite sides of the notch region 115, respectively. The first connection point CP1 may be substantially positioned at the central point between the first end 121 and the second end 122 of the first feeding element 120.

In some embodiments, the notch region 115 of the ground plane 110 is divided into a first portion 116, a second portion 117, and a third portion 118 by the first feeding element 120, the second feeding element 130, and the first radiation element 140. The first portion 116 of the notch region 115 has the largest area, and it is completely surrounded by the ground plane 110, the first feeding element 120, and the first radiation element 140. The second portion 117 of the notch region 115 has median area, and it is completely surrounded by the ground plane 110, the first feeding element 120, and the second feeding element 130. The third portion 118 of the notch region 115 has the smallest area, and it is partially surrounded by the first feeding element 120, the second feeding element 130, and the first radiation element 140. Specifically, the first portion 116 of the notch region 115 may substantially have an L-shape, and each of the second portion 117 and the third portion 118 of the notch region 115 may substantially have a rectangular shape, but they are not limited thereto.

The connection element 150 may substantially have a cylindrical shape. The connection element 150 may be substantially perpendicular to the ground plane 110. Specifically, the connection element 150 has a first end 151 and a second end 152. The first end 151 of the connection element 150 is coupled to a second connection point CP2 on the second feeding element 130. For example, the second connection point CP2 may substantially positioned at the central point between the first end 131 and the second end 132 of the second feeding element 130. Alternatively, the second connection point CP2 may be substantially positioned at a right-angle bending portion of the second feeding element 130. In some embodiments, the connection element 150 may be implemented with a pogo pin or a metal spring.

A combination of the second radiation element 160 and the third radiation element 170 may substantially have a U-shape. The length of the second radiation element 160 is at least 6 times the length of the third radiation element 170. Specifically, the second radiation element 160 has a first end 161 and a second end 162. The first end 161 of the second radiation element 160 is coupled to the second end 152 of the connection element 150. The second end 162 of the second radiation element 160 is an open end. The third radiation element 170 has a first end 171 and a second end 172. The first end 171 of the third radiation element 170 is coupled to the second end 152 of the connection element 150. The second end 172 of the third radiation element 170 is an open end. The second end 172 of the third radiation element 170 is adjacent to the second end 162 of the second radiation element 160. It should be noted that the term "adjacent" or "close" over the disclosure may mean that the distance (spacing) between two corresponding elements is smaller than a predetermined distance (e.g., 10 mm or the shorter), or it may mean that the two corresponding elements touch each other directly (i.e., the aforementioned distance/spacing therebetween is reduced to 0).

A 3D (Three-Dimensional) structure is formed by the connection element 150, the second radiation element 160, and the third radiation element 170. The second radiation element 160 and the third radiation element 170 are positioned on a plane which is different from and substantially parallel to the ground plane 110. The connection element 150 may be perpendicular to both the second radiation element 160 and the third radiation element 170. In some embodiments, the second radiation element 160 and the third radiation element 170 have a vertical projection on the ground plane 110, and the vertical projection at least partially overlaps the notch region 115.

Figure 2:
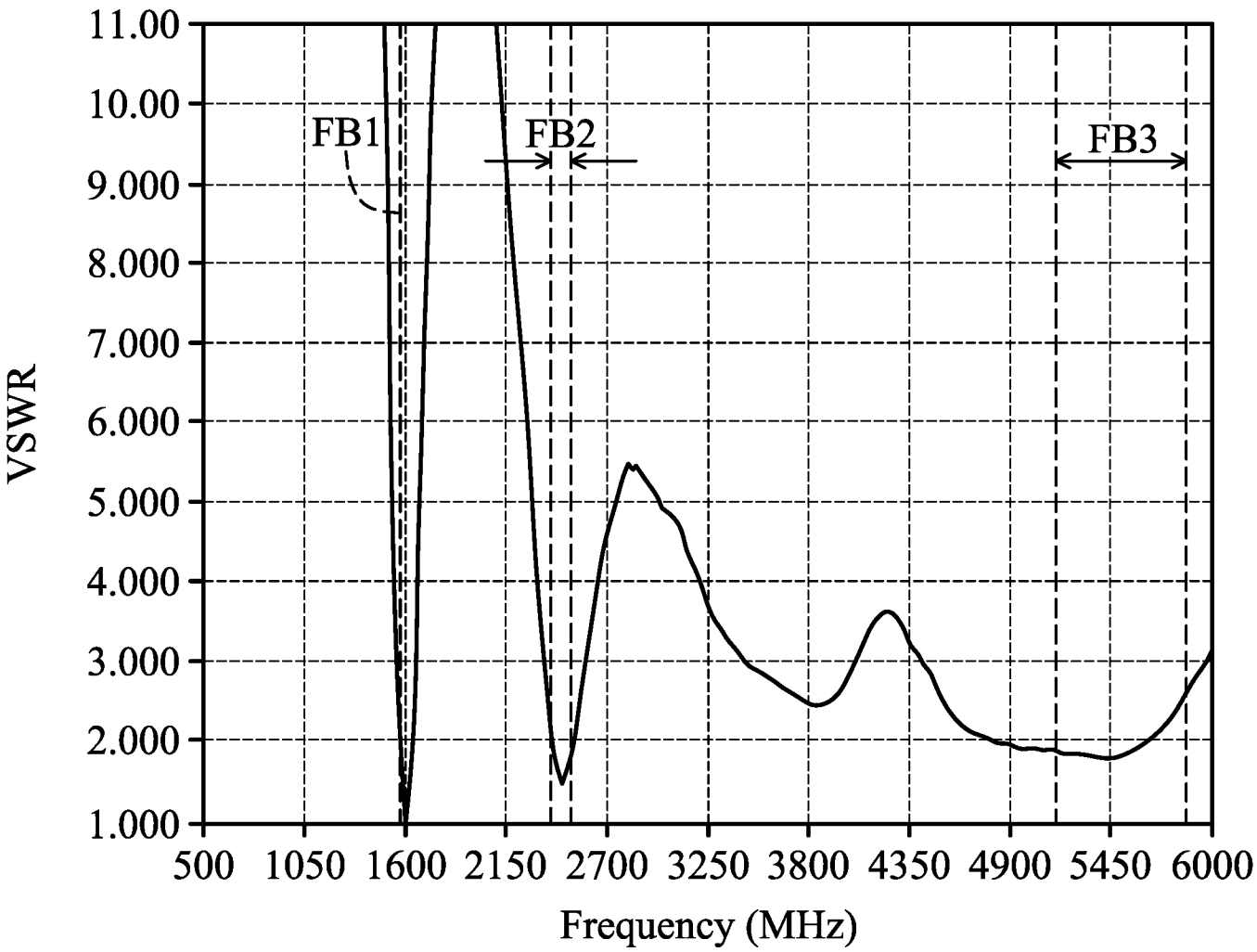
FIG. 2 is a diagram of VSWR (Voltage Standing Wave Ratio) of an antenna structure according to an embodiment of the invention.

FIG. 2 is a diagram of VSWR (Voltage Standing Wave Ratio) of the antenna structure 100 according to an embodiment of the invention. The horizontal axis represents operation frequency (MHz), and the vertical axis represents the VSWR. According to the measurement of FIG. 2, the antenna structure 100 can cover a first frequency band FB1, a second frequency band FB2, and a third frequency band FB3. For example, the first frequency band FB1 may be substantially at or around 1575 MHz, the second frequency band FB2 may be substantially from 2400 MHz to 2500 MHz, and the third frequency band FB3 may be substantially from 5150 MHz to 5850 MHz. Therefore, the antenna structure 100 can support at least the wideband operations of GPS (Global Positioning System) and WLAN (Wireless Local Area Networks) 2.4 GHz/5 GHz.

In some embodiments, the operation principles of the antenna structure 100 are as follows. The first feeding element 120 and the first radiation element 140 are excited to generate the first frequency band FB1. The first feeding element 120, the second feeding element 130, the connection element 150, and the second radiation element 160 are excited to generate the second frequency band FB2. The first feeding element 120, the second feeding element 130, the connection element 150, and the third radiation element 170 are excited to generate the third frequency band FB3. Since the antenna structure 100 includes a 3D structure (formed by the connection element 150, the second radiation element 160, and the third radiation element 170) which does not additionally occupy the clearance region on the ground plane 110, such a design can help to reduce the total antenna area and increase the antenna design flexibility. Furthermore, the first tuning circuit 181, the second tuning circuit 182, the third tuning circuit 183, and the fourth tuning circuit 184 are configured to fine-tune the impedance matching of the first frequency band FB1, the second frequency band FB2, and the third frequency band FB3, thereby minimizing the total size of the antenna structure 100.

In some embodiments, the element sizes and element parameters of the antenna structure 100 are as follows. The total length of the first feeding element 120 and the first radiation element 140 may be shorter than 0.25 wavelength ($\lambda/4$) of the first frequency band FB1. The total length of the first feeding element 120, the second feeding element 130, the connection element 150, and the second radiation element 160 may be substantially equal to 0.25 wavelength ($\lambda/4$) of the second frequency band FB2. The total length of the first feeding element 120, the second feeding element 130, the connection element 150, and the third radiation element 170 may substantially equal to 0.25 wavelength ($\lambda/4$) of the third frequency band FB3. Each of the first tuning circuit 181, the second tuning circuit 182, the third tuning circuit 183, and the fourth tuning circuit 184 may be a fixed capacitor or a variable capacitor. For example, the capacitance of the first tuning circuit 181 may be from 0.4 pF to 0.6 pF (preferably 0.5 pF), the capacitance of the second tuning circuit 182 may be from 8 pF to 12 pF (preferably 10 pF), the capacitance of the third tuning circuit 183 may be smaller than 0.1 pF (preferably 0 pF), and the capacitance of the fourth tuning circuit 184 may be from 0.7 pF to 1.1 pF (preferably 0.9 pF). The antenna structure 100 may have a total length of about 15 mm, a total width of about 8 mm, and a total height of about 4 mm. The above ranges of element sizes and element parameters are calculated and obtained according to many experiment results, and they help to optimize the operation bandwidth and the impedance matching of the antenna structure 100.

The invention proposes a novel wideband antenna structure, which includes a planar portion and a 3D portion. By adding a plurality of tuning circuits into the antenna structure, the invention can cover three or more operation frequency bands without additional increasing the total antenna area. Therefore, the invention has the advantages of both small size and wide bandwidth, and it is suitable for application in a variety of small-size mobile communication devices.

Note that the above element sizes, element shapes, element parameters, and frequency ranges are not limitations of the invention. An antenna designer can adjust these settings or values according to different requirements. It should be understood that the antenna structure of the invention is not limited to the configurations of FIGS. 1-2. The invention may merely include any one or more features of any one or more embodiments of FIGS. 1-2. In other words, not all of the features shown in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna structure, comprising:

a ground plane, having a notch region;

a first feeding element;

a first tuning circuit, coupled between a signal source and the first feeding element;

a second feeding element;

a second tuning circuit, coupled between the first feeding element and the second feeding element;

a third tuning circuit, coupled between the second feeding element and a first shorting point on the ground plane;

a first radiation element, coupled to the first feeding element;

a fourth tuning circuit, coupled between the first radiation element and a second shorting point on the ground plane;

a connection element, coupled to the second feeding element;

a second radiation element, coupled to the connection element; and a third radiation element, coupled to the connection element, wherein a 3D (Three-Dimensional) structure is formed by the connection element, the second radiation element, and the third radiation element.

2. The antenna structure as claimed in claim 1, wherein a planar structure is formed by the first feeding element, the second feeding element, and the first radiation element, and the planar structure is disposed inside the notch region.

3. The antenna structure as claimed in claim 1, wherein any of the first tuning circuit, the second tuning circuit, the third tuning circuit, and the fourth tuning circuit is a capacitor, an inductor, or a resistor.

4. The antenna structure as claimed in claim 1, wherein the connection element is substantially perpendicular to the ground plane.

5. The antenna structure as claimed in claim 1, wherein the second radiation element and the third radiation element are positioned on a plane which is different from and substantially parallel to the ground plane.

6. The antenna structure as claimed in claim 1, wherein a combination of the second radiation element and the third radiation element substantially has a U-shape.

7. The antenna structure as claimed in claim 1, wherein the antenna structure covers a first frequency band at or around 1575 MHz, a second frequency band from 2400 MHz to 2500 MHz, and a third frequency band from 5150 MHz to 5850 MHz.

8. The antenna structure as claimed in claim 7, wherein a total length of the first feeding element and the first radiation element is shorter than 0.25 wavelength of the first frequency band.

9. The antenna structure as claimed in claim 7, wherein a total length of the first feeding element, the second feeding element, the connection element, and the second radiation element is substantially equal to 0.25 wavelength of the second frequency band.

10. The antenna structure as claimed in claim 7, wherein a total length of the first feeding element, the second feeding element, the connection element, and the third radiation element is substantially equal to 0.25 wavelength of the third frequency band.

* * * * *